United States Patent [19]

Wertz et al.

[11] Patent Number: 4,561,998

[45] Date of Patent: Dec. 31, 1985

[54] NEAR-NEUTRAL PH DETERGENTS CONTAINING ANIONIC SURFACTANT, COSURFACTANT AND FATTY ACID

[75] Inventors: Jean-Luc H. M. Wertz, Ceroux-Mousty, Belgium; Pierre C. E. Goffinet, Bruxelles, France

[73] Assignee: The Procter & Gamble Company, Cincinnati, Ohio

[21] Appl. No.: 634,188

[22] Filed: Jul. 26, 1984

Related U.S. Application Data

[63] Continuation of Ser. No. 380,988, May 24, 1982, abandoned.

[51] Int. Cl.[4] ..... C11D 1/8; C11D 1/04

[52] U.S. Cl. ..... 252/547; 252/174.12; 252/528; 252/550; 252/551; 252/554; 252/555; 252/559; 252/DIG. 14; 252/548

[58] Field of Search ..... 252/110, 117, 526, 528, 252/545, 547, 550, 555, 558, DIG. 14

[56] References Cited

U.S. PATENT DOCUMENTS

| | | | |
|---|---|---|---|
| 3,714,074 | 1/1973 | Inamorato | 252/528 |
| 3,954,632 | 5/1976 | Gloss | 252/8.8 |
| 4,079,078 | 3/1978 | Collins | 252/545 |
| 4,142,999 | 3/1979 | Bloching et al. | 252/544 |
| 4,268,262 | 5/1981 | Bechstedt | 8/137 |
| 4,285,841 | 8/1981 | Barrat et al. | 252/559 |
| 4,287,082 | 9/1981 | Tolfo et al. | 252/174.12 |
| 4,302,364 | 12/1981 | Gosset et al. | 252/545 |
| 4,305,837 | 12/1981 | Kaminsky et al. | 252/174.12 |
| 4,318,818 | 3/1982 | Letton et al. | 252/174.12 |
| 4,321,165 | 3/1982 | Smith et al. | 252/528 |
| 4,333,862 | 6/1982 | Smith et al. | 252/547 |
| 4,391,726 | 7/1983 | Koster | 252/99 |

FOREIGN PATENT DOCUMENTS

| | | |
|---|---|---|
| 051986 | 5/1982 | European Pat. Off. . |
| 144099 | 11/1980 | Japan . |
| 12000 | 2/1981 | Japan . |
| 749888 | 7/1980 | U.S.S.R. . |

*Primary Examiner*—Prince E. Willis

*Attorney, Agent, or Firm*—Donald E. Hasse; Robert B. Aylor; Thomas H. O'Flaherty

[57] ABSTRACT

Detergent compositions, preferably heavy-duty liquids, containing an anionic surfactant, a selected consurfactant and a fatty acid are disclosed. The compositions are formulated to provide an initial pH of from about 6.0 to about 8.5 at a concentration of from about 0.1% to about 2% by weight in water at 20° C. The compositions preferably also contain ethoxylated nonionic surfactants, a detergent builder and enzymes.

13 Claims, No Drawings

NEAR-NEUTRAL PH DETERGENTS CONTAINING ANIONIC SURFACTANT, COSURFACTANT AND FATTY ACID

This is a continuation of application Ser. No. 380,988, filed on May 24, 1982, now abandoned.

TECHNICAL FIELD

The present invention relates to detergent compositions, preferably liquid detergents, containing an anionic synthetic surfactant, a cosurfactant selected from the group consisting of certain quaternary ammonium, diquaternary ammonium, amine, diamine, amine oxide and di(amine oxide) surfactants, and a fatty acid. The compositions herein have a molar ratio of the anionic synthetic surfactant to the cosurfactant of at least 1 and are formulated to provide an initial pH of from about 6.0 to about 8.5 at a concentration of from about 0.1% to about 2% by weight in water at 20° C. The compositions provide both superior greasy/oily soil removal and good builder/pH sensitive soil removal at the near-neutral wash pH.

BACKGROUND ART

U.S. Pat. No. 4,285,841, Barrat et al, issued Aug. 25, 1981, discloses liquid detergents containing anionic surfactants, nonionic surfactants and from about 8% to about 20% by weight of a fatty acid. The compositions have a pH of from about 6.0 to 7.5.

U.S. Pat. No. 4,287,082, Tolfo et al, issued Sept. 1, 1981, discloses liquid detergents containing saturated fatty acids, enzymes, enzyme-accessible calcium and selected short-chain carboxylic acids.

U.S. Pat. No. 4,321,165, Smith et al, issued Mar. 23, 1982, discloses built detergents containing anionic, nonionic and cationic surfactants. The compositions provide a solution pH of at least about 6, and preferably greater than about 8.

SUMMARY OF THE INVENTION

The present invention encompasses detergent compositions comprising:

(a) from about 2% to about 60% by weight of an anionic synthetic surfactant;

(b) from about 0.25% to about 12% by weight of a cosurfactant selected from the group consisting of:

(i) quaternary ammonium surfactants having the formula:

$$[R^2(OR^3)_y][R^4(OR^3)_y]_2R^5N^+X^-$$

wherein $R^2$ is an alkyl or alkyl benzyl group having from about 8 to about 18 carbon atoms in the alkyl chain; each $R^3$ is selected from the group consisting of $-CH_2CH_2-$, $-CH_2CH(CH_3)-$, $-CH_2CH(CH_2OH)-$, $-CH_2CH_2CH_2-$, and mixtures thereof; each $R^4$ is selected from the group consisting of $C_{1-4}$ alkyl, $C_{1-4}$ hydroxyalkyl, benzyl, ring structures formed by joining the two $R^4$ groups, $-CH_2CHOHCHOHCOR^6CHOHCH_2OH$ wherein $R^6$ is any hexose or hexose polymer having a molecular weight up to about 1000, and hydrogen when y is not 0; $R^5$ is the same as $R^4$ or is an alkyl chain wherein the total of carbon atoms of $R^2$ plus $R^5$ is not more than about 18; each y is from 0 to about 10 and the sum of the y values is from 0 to about 15; and X is any compatible anion;

(ii) diquaternary ammonium surfactants having the formula:

$$[R^2(OR^3)_y][R^4(OR^3)_y]_2N^+R^3N^+R^5[R^4(OR^3)_y]_2(X^-)_2$$

wherein $R^2$, $R^3$, $R^4$, $R^5$, y and X are as defined above;

(iii) amine surfactants having the formula:

$$[R^2(OR^3)_y][R^4(OR^3)_y]R^5N$$

wherein $R^2$, $R^3$, $R^4$, $R^5$ and y are as defined above;

(iv) diamine surfactants having the formula:

$$[R^2(OR^3)_y][R^4(OR^3)_y]NR^3NR^5[R^4(OR^3)_y]$$

wherein $R^2$, $R^3$, $R^4$, $R^5$ and y are as defined above;

(v) amine oxide surfactants having the formula:

$$[R^2(OR^3)_y][R^4(OR^3)_y]R^5N\rightarrow O$$

wherein $R^2$, $R^3$, $R^4$, $R^5$ and y are as defined above; and (vi) di(amine oxide) surfactants having the formula:

$$[R^2(OR^3)_y][R^4(OR^3)_y]N(\rightarrow O)R^3N(\rightarrow O)R^5[R^4(OR^3)_y]$$

wherein $R^2$, $R^3$, $R^4$, $R^5$ and y are as defined above; and (c) from about 5% to about 40% by weight of a fatty acid containing from about 10 to about 22 carbon atoms; said composition having a molar ratio of the anionic synthetic surfactant to the cosurfactant of at least 1 and formulated to provide an initial pH of from about 6.0 to about 8.5 at a concentration of from about 0.1% to about 2% by weight in water at 20° C.

DETAILED DESCRIPTION OF THE INVENTION

The detergent compositions herein contain an anionic synthetic surfactant, a cosurfactant selected from certain quarternary ammonium, diquaternary ammonium, amine, diamine, amine oxide and di(amine oxide) surfactants, and a fatty acid material. The compositions can be in any form, including granules, liquids, tablets or pastes. However, liquid compositions are highly preferred since the compositions herein are especially effective when applied directly to soils and stains in a pretreatment step. The compositions herein must have a molar ratio of the anionic synthetic surfactant to the cosurfactant of a least one, preferably from about 2:1 to about 20:1, and are formulated to provide an initial pH of from about 6.0 to about 8.5 at a concentration of from about 0.1% to about 2% by weight in water at 20° C. It has been found that the addition of the cosurfactant to the fatty acid containing detergents herein provides important greasy/oily soil removal benefits only at the near-neutral wash pH. The wash pH is preferably from about 7.0 to about 8.5, more preferably from about 7.5 to about 8.0.

While not intending to be limited by theory, it is believed that the cosurfactant and anionic surfactant herein form complexes which enhance packing of the surfactants at the oil/water interface, thereby lowering interfacial tension and improving detergency. (The amine, diamine, amine oxide and di(amine oxide) surfactants would be at least partially protonated at the near-neutral pH and thus can form charges species capable of complexing with the anionic surfactant.) At the defined pH range recited herein, the fatty acid component exists in a chemical form which is optimal for effective detergency. At too low a pH, the non-dissociated form of the acid is ineffective. It is also believed that the higher pH's (i.e., above about 8.5) affect the interaction of the fatty acid with the cosurfactant and water hardness and result in the formation of undesirable species at the oil/water interface which reduce detergency performance.

ANIONIC SYNTHETIC SURFACTANT

The detergent compositions herein contain from about 2% to about 60% by weight of an anionic synthetic surfactant, or mixtures thereof. The anionic surfactant preferably represents from about 5% to about 40%, and more preferably from about 10% to about 20%, by weight of the detergent composition. Anionic surfactants useful herein are disclosed in U.S. Pat. No. 4,285,841, Barret et al, issued Aug. 25, 1981, and in U.S. Pat. No. 3,919,678, Laughlin et al, issued Dec. 30, 1975, both incorporated herein by reference.

Useful anionic surfactants include the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 20 carbon atoms and a sulfonic acid or sulfuric acid ester group. (Included in the term "alkyl" is the alkyl portion of aryl groups.) Examples of this group of synthetic surfactants are the alkyl sulfates, especially those obtained by sulfating the higher alcohols ($C_8$–$C_{18}$ carbon atoms) such as those produced by reducing the glycerides of tallow or coconut oil; and the alkylbenzene sulfonates in which the alkyl group contains from about 9 to about 15 carbon atoms, in straight chain or branched chain configuration, e.g., those of the type described in U.S. Pat. No. 2,220,099 and No. 2,477,383. Especially valuable are linear straight chain alkylbenzene sulfonates in which the average number of carbon atoms in the alkyl group is from about 11 to 14.

Other anionic surfactants herein are the water-soluble salts of: paraffin sulfonates containing from about 8 to about 24 (preferably about 12 to 18) carbon atoms; alkyl glyceryl ether sulfonates, especially those ethers of $C_{8-18}$ alcohols (e.g., those derived from tallow and coconut oil); alkyl phenol ethylene oxide ether sulfates containing from about 1 to about 4 units of ethylene oxide per molecule and from about 8 to about 12 carbon atoms in the alkyl group; and alkyl ethylene oxide ether sulfates containing about 1 to about 4 units of ethylene oxide per molecule and from about 10 to about 20 carbon atoms in the alkyl group.

Other useful anionic surfactants herein include the water-soluble salts of esters of α-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and β-alkyloxy alkane sulfonates containing from about 1 to 3 carbon atoms in the alkyl group and from about 8 to 20 carbon atoms in the alkane moiety.

Particularly preferred anionic surfactants herein are the alkyl sulfates of the formula $$RO(C_2H_4O)_xSO_3^-M^+$$

wherein R is an alkyl chain having from about 8 to about 18 carbon atoms, saturated or unsaturated, and the longest linear portion of the alkyl chain is 15 carbon atoms or less on the average, M is a cation which makes the compound water-soluble, especially an alkali metal, ammonium or substituted ammonium cation, and x is from 0 to about 4. Most preferred are the non-ethoxylated $C_{12-15}$ primary and secondary alkyl sulfates. Under cold water washing conditions, i.e., less than about 65° F. (18.3° C.), it is preferred that there be a mixture of such alkyl sulfates.

Mixtures of the alkyl sulfates with the above-described alkylbenzene sulfonates, paraffin sulfonates, alkyl glyceryl ether sulfonates and esters of a α-sulfonated fatty acids, particularly with the $C_{11-13}$ linear alkylbenzene sulfonates, are also preferred.

COSURFACTANT

The compositions herein also contain from about 0.25% to about 12%, preferably from about 0.5% to about 8%, more preferably from about 1% to about 4%, by weight of a cosurfactant selected from the group of certain quaternary ammonium, diquaternary ammonium, amine, diamine, amine oxide and di(amine oxide) surfactants. The quaternary ammonium surfactants are particularly preferred.

The quaternary ammonium surfactants herein are of the formula:

$$[R^2(OR^3)_y][R^4(OR^3)_y]_2R^5N^+X^-$$

wherein $R^2$ is an alkyl or alkyl benzyl group having from about 8 to about 18 carbon atoms in the alkyl chain; each $R^3$ is selected from the group consisting of $-CH_2CH_2-$, $-CH_2CH(CH_3)-$, $-CH_2CH(CH_2OH)-$, $-CH_2CH_2CH_2-$, and mixtures thereof; each $R^4$ is selected from the group consisting of $C_{1-4}$ alkyl, $C_{1-4}$ hydroxyalkyl, benzyl, ring structures formed by joining the two $R^4$ groups, $-CH_2CHOHCHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Preferred of the above are the alkyl quaternary ammonium surfactants, especially the mono-long chain alkyl surfactants described in the above formula when $R^5$ is selected from the same groups as $R^4$. The most preferred quaternary ammonium surfactants are the chloride, bromide and methylsulfate $C_{8-16}$ alkyl trimethylammonium salts, $C_{8-16}$ alkyl di(hydroxyethyl)-methylammonium salts, the $C_{8-16}$ alkyl hydroxethyl-dimethylammonium salts, and $C_{8-16}$ alkyloxypropyl trimethylammonium salts. Of the above, decyl trimethylammonium methylsulfate, lauryl trimethylammonium chloride, myristyl trimethylammonium bromide and coconut trimethylammonium chloride and methylsulfate are particularly preferred.

Under cold water washing conditions, i.e., less than about 65° F. (18.3° C.), the $C_{8-10}$ alkyltrimethyl ammonium surfactants are particularly preferred since they have a lower Kraft boundry and, therefore, a lower crystallization temperature than the longer alkyl chain quaternary ammonium surfactants herein.

Diquaternary ammonium surfactants herein are of the formula:

$$[R^2(OR^3)_y][R^4(OR^3)_y]_2N^+R^3N^+R^5[R^4(OR^3)_y]_2 \quad (X^-)_2$$

wherein the $R^2$, $R^3$, $R^4$, $R^5$, y and X substituents are as defined above for the quaternary ammonium surfactants. These substituents are also preferably selected to provide diquaternary ammonium surfactants corresponding to the preferred quanternary ammonium surfactants. Particularly preferred are the $C_{8-16}$ alkyl pentamethylethylenediammonium chloride, bromide and methylsulfate salts.

Amine surfactants useful herein are of the formula:

$$[R^2(OR^3)_y][R^4(OR^3)_y]R^5N$$

wherein the $R^2$, $R^3$, $R^4$, $R^5$ and y substituents are as defined above for the quaternary ammonium surfactants. Particularly preferred are the $C_{12-16}$ alkyl dimethyl amines.

Diamine surfactants herein are of the formula $$[R^2(OR^3)_y][R^4(OR^3)_y]NR^3NR^5[R^4(OR^3)_y]$$

wherein the $R^2$, $R^3$, $R^4$, $R^5$ and y substituents are as defined above. Preferred are the $C_{12-16}$ alkyl trimethylethylene diamines.

Amine oxide surfactants useful herein are of the formula:

$$[R^2(OR^3)_y][R^4(OR^3)_y]R^5N\rightarrow 0$$

wherein the $R^2$, $R^3$, $R^4$, $R^5$ and y substituents are also as defined above for the quaternary ammonium surfactants. Particularly preferred are the $C_{12-16}$ alkyl dimethyl amine oxides.

Di(amine oxide) surfactants herein are of the formula:

$$[R^2(OR^3)_y][R^4(OR^3)_y]NR^3NR^5[R^4(OR^3)_y]$$
$$\downarrow \quad \downarrow$$
$$O \quad O$$

wherein the $R^2$, $R^3$, $R^4$, $R^5$ and y substituents are as defined above. Preferred is $C_{12-16}$ alkyl trimethylethylene di(amine oxide).

FATTY ACID

The compositions of the present invention contain from about 5% to about 40%, preferably from about 7% to about 30%, most preferably from about 10% to about 20%, by weight of a fatty acid containing from about 10 to about 22 carbon atoms. The fatty acid can also contain from about 1 to about 10 ethylene oxide units in the hydrocarbon chain.

Suitable fatty acids are saturated and/or unsaturated and can be obtained from natural sources such as plant or animal esters (e.g., palm kernel oil, palm oil, coconut oil, babassu oil, safflower oil, tall oil, castor oil, tallow and fish oils, grease, and mixtures thereof) or synthetically prepared (e.g., via the oxidation of petroleum or by hydrogenation of carbon monooxide via the Fisher-Tropsch process). Examples of suitable saturated fatty acids for use in the compositions of this invention include capric, lauric, myristic, palmitic, stearic, arachidic and behenic acid. Suitable unsaturated fatty acid species include: palmitoleic, oleic, linoleic, linolenic and ricinoleic acid. Examples of preferred fatty acids are saturated $C_{10}$–$C_{14}$ (coconut) fatty acids, from about 5:1 to 1:1 (preferaby about 3:1) weight ratio mixtures of lauric and myristic acid, and mixtures of the above lauric/myristic blends with oleic acid at a weight ratio of about 4:1 to 1:4 mixed lauric/myristic:oleic.

OPTIONAL COMPONENTS

The compositions of the present invention also preferably contain up to about 30%, preferably from about 1% to about 20%, more preferably from about 5% to about 15%, by weight of an ethoxylated nonionic surfactant. These materials are described in U.S. Pat. No. 4,285,841, Barret et al, issued Aug. 25, 1981, incorporated herein by reference. Preferred are the ethoxylated alcohols and ethoxylated alkyl phenols of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, n is from about 3 to about 9, and said nonionic surfactant has an HLB (hydrophile-lipophile balance) value of from about 10 to about 13. These surfactants are more fully described in U.S. Pat. No. 4,284,532, Leikhim et al, issued Aug. 18, 1981, incorporated herein by reference. Particularly preferred are ethoxylated alcohols having an average of from about 10 to about 15 carbon atoms in the alcohol and an average degree of ethoxylation of from about 3 to about 8 moles of ethylene oxide per mole of alcohol.

The compositions herein also preferably contain up to about 40%, more preferably from about 1% to about 30%, by weight of a detergent builder material. While all manner of detergent builders known in the art can be used in the present compositions, the type and level of builder must be selected such that the final composition has an initial pH of from about 6.0 to about 8.5 at a concentration of from about 0.1% to about 1% by weight in water at 20° C. Detergent builders are described in U.S. Pat. No. 4,321,165, Smith et al, issued Mar. 23, 1982, incorporated herein by reference. In the preferred liquid detergent compositions herein, the builder preferably represents from about 1% to about 20%, more preferably from about 3% to about 10%, by weight of the composition. Preferred builders for use in liquid detergents herein are described in U.S. Pat. No. 4,284,532, Leikhim et al, issued Aug. 18, 1981, incorporated herein by reference. A particularly preferred builder is citric acid.

Other preferred components for use in liquid detergents herein are the neutralizing agents, buffering agents, phase regulants, hydrotropes, enzymes, enzyme stabilizing agents, polyacids, suds regulants, opacifiers, antioxidants, bactericides, dyes, perfumes, and brighteners described in the U.S. Pat. No. 4,285,841, Barrat et al, issued Aug. 25, 1981, incorporated herein by reference. Preferred neutralizing agents for use herein are organic bases, especially triethanolamine and monoethanolamine, which result in better detergency performance than inorganic bases such as sodium and potassium hydroxides. Particularly preferred compositions herein contain from about 0.1% to about 2% by weight of detersive enzymes, especially the amylases, proteases, and mixtures thereof, of the type well known to detergent formulators.

The following non-limiting examples illustrate the compositions of the present invention. All percentages, parts and ratios used herein are by weight unless otherwise specified.

EXAMPLE I

Four sets of 7.6 cm square polycotton (P/C) or cotton (C) swatches stained with standard soils were washed in an automatic mini-washer using 2000 ppm of either Composition A, a commercially available heavy-duty liquid detergent; Composition B containing, by weight, 6.2% sodium $C_{13}$ linear alkylbenzene sulfonate, 9.4% sodium $C_{14-15}$ alkyl sulfate, 10.0% $C_{12-13}$ alcohol polyethyoxylate (6.5), 10.0% coconut fatty acid, 5.0% oleic fatty acid, 15% citric acid, 0.3% diethylenetriame pentamethylene phosphonic acid, 0.23% brightener, 1.0% protease enzyme, enough monoethanolamine to achieve the desired pH and the balance, to 100% water; Composition C, which was B plus 2.7% by weight of $C_{12}$ alkyl trimethylammonium chloride; or Composition D, which was B plus 2.7% by weight of $C_{12-16}$ alkyl dimethyl amine oxide. The wash pH was about 7.3 for Composition A and about 7.4 for B, C and D. The wash water temperature was 95° F. (35° C.) and the water hardness was 5 grains/gallon (3:1 $Ca^{++}$:$Mg^{++}$). The swatches were then dried and each set was round robin comparison graded against its counterparts to determine relative soil removal provided by the detergent compositions. A grading scale of −4 to 4 was used, with −4 indicating much less soil removal, 0 indicating no difference and 4 indicating much more soil removal. The results for each composition were then averaged and Composition A was assigned a relative value of 0.

A similar comparison was made except that the wash pH for Compositions B, C and D was about 9.5.

The results were as follows.

| Composition | | Wash pH 7.4 | | | Wash pH 9.5 | | |
|---|---|---|---|---|---|---|---|
| Soil | Fabric | B | C | D | B | C | D |
| Bacon grease | P/C | 0.1 | 1.6 | 0.9 | 0.6 | 0.7 | 0.5 |
| Synthetic dirty motor oil | P/C | 0.1 | 1.9 | 2.6 | −0.7 | 1.0 | 0.6 |
| Makeup (oil base) | P/C | −0.5 | 1.5 | 1.6 | −2.0 | −1.7 | −2.6 |
| Spaghetti sauce | P/C | −1.3 | −1.7 | −1.8 | −0.5 | −0.7 | −0.1 |
| Chocolate | C | 1.5 | 1.0 | −0.2 | −0.4 | −2.0 | −2.0 |
| Grass | P/C | −1.6 | 1.8 | 2.3 | 3.5 | 3.6 | 4.2 |
| Gravy | C | 0.9 | 0.5 | 1.6 | 4.0 | 3.6 | 3.7 |
| Clay | P/C | 2.2 | 3.7 | 3.3 | −1.0 | 0.9 | −0.8 |
| Clay | C | 3.2 | 2.9 | 3.5 | 4.1 | 3.6 | 3.2 |
| Body Soil | P/C | 0.6 | 0.4 | 0.5 | 0.8 | 1.3 | 0.8 |

The above results demonstrate that Compositions C and D of the present invention containing quaternary ammonium and amine oxide cosurfactants, respectively, provide important advantages on greasy/oil soils and also on grass and clay (on PC) relative to Composition B at wash pH's of 7.4. However, these advantages are substantially eliminated at wash pH's of 9.5.

As demonstrated above, the present invention also encompasses a method for laundering fabrics comprising contacting said fabrics with an aqueous solution having a pH of from about 6.0 to about 8.5 at 20° C. and containing at least about 0.1% by weight of the compositions herein.

EXAMPLE II

Liquid detergent compositions of the present invention are as follows.

| Component | Wt. % A | Wt. % B |
|---|---|---|
| $C_{13}$ linear alkylbenzene sulfonic acid | 5.8 | 5.5 |
| Coconutalkyl sulfuric acid | 8.8 | 8.3 |
| $C_{12}$ alkyl trimethylammonium chloride | 1.2 | — |
| $C_{14}$ alkyl trimethylammonium bromide | — | 1.7 |
| $C_{12-13}$ alcohol polyethoxylate (6.5) | 10.0 | — |
| $C_{13-15}$ alcohol polyethoxylate (7) | — | 9.4 |
| Lauric acid | 7.5 | 7.1 |
| Myristic acid | 2.5 | 2.3 |
| Oleic acid | 5.0 | 4.7 |
| Citric acid monohydrate | 7.5 | 5.7 |
| Diethylenetriamine pentamethylene-phosphonic acid | 0.3 | 0.3 |
| Diethylenetriamine pentaacetic acid | 0.3 | 0.3 |
| Protease enzyme | 1.0 | 1.0 |
| Amylase enzyme | 0.3 | 0.3 |
| Monoethanolamine | 12.0 | — |
| Triethanolamine | 6.7 | 7.5 |
| Sodium hydroxide | — | 3.2 |
| Potassium hydroxide | — | 4.0 |
| 1,2 Propanediol | 5.0 | 8.5 |
| Ethanol | 1.0 | 4.7 |
| Sodium formate | 1.0 | 1.0 |
| Sodium toluene sulfonate | 5.0 | — |
| Minors and water | Balance to 100 | |

*45% branched

Composition A was prepared by adding the components, with continuous mixing, in the following order: alcohol polyethoxylate; monoethanolamine; premix of coconutalkyl sulfuric acid paste (containing propanediol, triethanolamine, coconutalkyl sulfuric acid, water and minors) and monoethanolamine-neutralized alkylbenzone sulfonic acid; premix of toluene sulfonate and water; citric acid; alkyl trimethylammonium chloride; premix of fatty acids; phosphonic acid, acetic acid; premix of dye, brightener, formate, ethanol and water; adjust pH to about 8.1 with monoethanolamine or water; protease enzyme; amylase enzyme; and perfume. The product obtained was a clear liquid. It exhibited better detergency performance than a similar product obtained by adding the fatty acids prior to adding the alkyltrimethylammonium chloride. The product also exhibited better detergency performance, phase stability and a less objectionable base odor than a similar product obtained by adding the monoethanolamine after the premix of the coconut alkyl sulfuric acid paste and the neutralized alkylbenzene sulfonic acid.

Composition B was obtained by mixing the components.

Other compositions of the present invention are obtained when the alkyl trimethylammonium halides in the above compositions are replaced with coconutalkyl trimethylammoniium chloride, decyl trimethylammonium methylsulfate, lauryl di(hydroxyethyl) methylammonium chloride, decyloxypropyl trimethylammonium chloride, lauryl pentamethylethylenediammonium chloride, lauryl diethanolamine, coconutalkyl trimethylethylene diamine, $C_{12-16}$ alkyl dimethyl amine oxide, or with coconutalkyl trimethylethylene di(amine oxide).

Other compositions herein are obtained when, in the above compositions, the $C_{13}$ linear alkylbenzene sulfonic acid is replaced with coconutalkyl sulfuric acid or $C_{14-15}$ alkyl sulfuric acid, and when the coconutalkyl sulfuric acid is replaced with $C_{14-15}$ alkyl ethoxy (1 avg.) sulfuric acid.

Compositions of the present invention are also obtained when the lauric/myristic/oleic fatty acid mixture in the above compositions is replaced with coconut fatty acid or a 3:1 weight ratio mixture of lauric and myristic acid.

Granular detergents of the present invention can be obtained by spray-drying the above compositions and admixing heat sensitive materials such as the enzymes.

What is claimed is:

1. A detergent composition comprising:

(a) from about 2% to about 60% by weight of an anionic synthetic surfactant;

(b) from about 0.25% to about 12% by weight of a cosurfactant selected from the group consisting of:

(i) quarternary ammonium surfactants having the formula:

$$[R^2(OR^3)_y][R^4(OR^3)_y]_2R^5N^+X^-$$

wherein $R^2$ is an alkyl or alkyl benzyl group having from about 8 to about 18 carbon atoms in the alkyl chain; each $R^3$ is selected from the group consisting of $-CH_2CH_2-$, $-CH_2CH(CH_3)-$, $-CH_2CH(CH_2OH)-$, $-CH_2CH_2CH_2-$, and mixtures thereof; each $R^4$ selected from the group consisting of $C_{1-4}$ alkyl, $C_{1-4}$ hydroxyalkyl, benzyl, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion; and (ii) diquaternary ammonium surfactants having the formula:

$$[R^2(OR^3)_y][R^4(OR^3)_y]_2N^+R^3N^+R^5[R^4(OR^3)_y]_2(X^-)_2$$

wherein $R^2$, $R^3$, $R^4$, y and x are as defined above;

(c) from about 5% to about 40% by weight of a fatty acid containing from about 10 to about 22 carbon atoms; and (d) from about 3% to about 10% by weight of a detergent builder;

said composition having a molar ratio of the anionic synthetic surfactant to the cosurfactant of at least 1 and formulated to provide an initial pH of from about 6.0 to about 8.5 at a concentration of from about 0.1% to about 2% by weight in water at 20° C.

2. The composition of claim 1 wherein the anionic surfactant comprises an alkyl sulfate of the formula $$RO(C_2H_4O)_xSO_3^-M^+$$

wherein R is an alkyl chain having from about 8 to about 18 carbon atoms, saturated or unsaturated, and the longest linear portion of the alkyl chain is 15 carbon atoms or less on the average, M is a cation which makes the compound water-soluble, and x is from 0 to about 4.

3. The composition of claim 2 wherein in the alkyl sulfate surfactant, R is an alkyl group containing from about 12 to about 15 carbon atoms, x is from 0 to about 4 and M is an alkali metal, ammonium or substituted ammonium cation.

4. The composition of claim 2 wherein the anionic surfactant additionally comprises a water-soluble salt of an alkylbenzene sulfonate, paraffin sulfonate, alkyl glyceryl ether sulfonate or an ester of an $\alpha$-sulfonated fatty acid.

5. The composition of claim 2 wherein the anionic surfactant additionally comprises an alkali metal, ammonium or substituted ammonium salt of a linear alkylbenzene sulfonate containing from about 11 to about 14 carbon atoms in the alkyl chain.

6. The composition of claim 1 wherein the cosurfactant is selected from the group consisting of the chloride, bromide and methylsulfate $C_{8-16}$ alkyl trimethylammonium salts, $C_{8-16}$ alkyl di(hydroxyethyl) methylammonium salts, $C_{8-16}$ alkyl hydroxyethyldimethylammonium salts, and $C_{8-16}$ alkyloxypropyl trimethylammonium salts.

7. The compositions of claim 6 wherein the cosurfactant is decyl trimethylammonium methylsulfate, lauryl trimethylammonium chloride, myristyl trimethylammonium bromide and coconut alkyl trimethylammonium chloride and methylsulfonate.

8. The compositions of claim 1 wherein the fatty acid comprises a material containing from about 10 to about 14 carbon atoms, or mixtures thereof.

9. The compositions of claim 5 wherein the cosurfactant is selected from the group consisting of the chloride, bromide and methylsulfate $C_{8-16}$ alkyl trimethylammonium salts, $C_{8-16}$ alkyl di(hydroxyethyl) methylammonium salts, $C_{8-16}$ alkyl hydroxyethyldimethylammonium salts, and $C_{8-16}$ alkyloxypropyl trimethylammonium salts, and the fatty acid comprises a material containing from about 10 to about 14 carbon atoms, or mixtures thereof.

10. A detergent composition according to claim 9 comprising from about 10% to about 20% by weight of the anionic synthetic surfactant, from about 0.5 % to about 8% by weight of the cosurfactant, and from about 10% to about 20% by weight of the fatty acid.

11. The composition of claim 10 additionally comprising from about 0.1 to about 2% by weight of an enzyme suitable for use in detergent compositions selected from the group consisting of amylases, proteases, and mixtures thereof.

12. The composition of claim 11 wherein the builder comprises citric acid.

13. A method for laundering fabrics comprising contacting said fabrics with an aqueous solution having a pH of from about 6.0 to about 8.5 at 7.0° C. and containing at least about 0.1% by weight of the composition of claim 1.

* * * * *

UNITED STATES PATENT AND TRADEMARK OFFICE

CERTIFICATE OF CORRECTION

PATENT NO. : 4,561,998

DATED : December 31, 1985

INVENTOR(S) : Jean-Luc H. M. Wertz et al

It is certified that error appears in the above-identified patent and that said Letters Patent are hereby corrected as shown below:

Column 1, line 65, "total of carbon atoms" should be --total number of carbon atoms--.

Column 2, line 3, "$N^{+R3}$" should be --$N^{+}R^{3}$--.

Column 9, line 14, "A detergent" should be --A liquid detergent--.

Column 10, line 30, "methylsulfonate" should be --methylsulfate--.

Signed and Sealed this

*Twenty-fifth* Day of *February 1986*

[SEAL]

*Attest:*

DONALD J. QUIGG

*Attesting Officer*

*Commissioner of Patents and Trademarks*